United States Patent [19]

Yang

[11] Patent Number: 4,694,711

[45] Date of Patent: Sep. 22, 1987

[54] ADJUSTABLE WRENCH

[76] Inventor: Tai-Her Yang, 5-1 Taipin St., Si-Hu Town, Dzan-Hwa, Taiwan

[21] Appl. No.: 905,533

[22] Filed: Sep. 10, 1986

[51] Int. Cl.[4] ..... B25B 13/00

[52] U.S. Cl. ..... 81/57.5; 81/98

[58] Field of Search ..... 81/57.5, 97, 98

[56] References Cited

U.S. PATENT DOCUMENTS

| | | | |
|---|---|---|---|
| 701,462 | 6/1902 | Behmann et al. | 81/98 |
| 1,168,204 | 1/1916 | Helstrom | 81/57.5 |
| 3,670,604 | 6/1972 | Fromell | 81/98 |
| 4,084,456 | 4/1978 | Pasbrig | 81/98 |

FOREIGN PATENT DOCUMENTS

| | | | |
|---|---|---|---|
| 747189 | 6/1933 | France | 81/57.5 |

*Primary Examiner*—Frederick R. Schmidt

*Assistant Examiner*—Judy J. Hartman

*Attorney, Agent, or Firm*—Leonard Bloom

[57] ABSTRACT

A wrench adjustable for use with various size workpieces is disclosed. The wrench has a rearward gripping portion and a forward portion being integral therewith. The forward portion has a slot formed laterally therethrough and further has an aperture including a gripping portion formed therethrough. A wrench plate is rotatably received in the slot. This wrench plate includes a periphery having a plurality of notches formed therein. Each of said notches may be selectively positioned in communication with the aperture, whereby the workpiece may be disposed between the gripping portion of the aperture and a selective notch of the wrench plate where it is gripped for the tightening or removal thereof. If desired, a detent member is also provided for maintaining the wrench plate in a stationary position during the use thereof.

15 Claims, 4 Drawing Figures

ADJUSTABLE WRENCH

FIELD OF THE INVENTION

The present invention relates to wrenches and, in particular, to wrenches which are adjustable for use with various size workpieces.

BACKGROUND OF THE INVENTION

There have been numerous attempts, of which I am aware, to fabricate a wrench which combines the ability to be adjustable for use with various sized workpieces and the convenience of being fabricated for use as a single unit. Unfortunately, all of the proposed wrenches are disadvantageous in that they either: have loose pieces which may be lost and which present storage problems; are large, bulky and require extra amounts of storage space; and/or are expensive to fabricate. Also, these proposed wrenches are often either difficult to use and to adjust, or require the individual to employ both hands during the use thereof.

Thus, it will be appreciated that there remains a need for a wrench which is fabricated for use as a single unit and which is adjustable for use with various sized workpieces.

SUMMARY OF THE INVENTION

Accordingly, it is the objective of the present invention to alleviate the disadvantages and deficiencies of the prior art by providing a wrench fabricated for use as a single unit which is adjustable for use with various size workpieces.

In accordance with the teachings of the present invention, a wrench for tightening and loosening a workpiece having a polygonal-shaped body is provided. This wrench has a handle having a rearward gripping portion and a forward wrench portion integral therewith. Said forward wrench portion has a slot formed therethrough. Said forward wrench portion further has an aperture including a gripping portion being formed therethrough. A wrench plate is removeably received in the slot. Said wrench plate includes a periphery having a plurality of notches formed therein, such that each of said notches may be selectively positioned in communication with the aperture, whereby the workpiece may be disposed between the gripping portion of the aperture and received within a selective notch of the wrench plate where it is gripped for the tightening and removal thereof.

In further accordance with the teachings of the present invention, a wrench for tightening and loosening a workpiece having a polygonal shaped body is provided. This wrench has a handle having a rearward gripping portion and a forward wrench portion integral therewith. Said forward wrench portion has a slot formed therethrough. Said forward wrench portion further has an aperture including a gripping portion being formed therethrough. A wrench plate includes a periphery, said plate being mounted for rotational movement in the slot about a centrally positioned axis. Said wrench plate has a plurality of notches formed therein about the periphery thereof, such that said notches may be selectively positioned in communication with the aperture, whereby the workpiece may be disposed between the gripping portion of the aperture and received within a respective selected notch, where it is gripped for the tightening and removal thereof.

In one embodiment, the aperture has a polygonal configuration. In another embodiment, the polygonal configuration is hexagonal. In still another embodiment, three adjacent sides of the hexagonal aperture positioned nearest to the gripping portion of the handle are each formed having a length being substantially identical to each other. A fourth side is adjacent to one side of the said three adjacent sides. A fifth side is adjacent to the other opposite side of the said three adjacent sides. Said fourth and fifth sides each have a length being substantially identical to one another and each further have a length being substantially longer than any one of the three adjacent sides. A sixth side is positioned between and adjacent to the fourth side and the fifth side. Finally, the internal angle between each adjacent side of the aperture is substantially 120°. In still yet another embodiment, the gripping portion of the aperture is comprised of the fourth side, fifth side and the sixth side.

In a further embodiment, the notches of the wrench plate are formed having three sides, each of said sides having a length being substantially identical to each other. In a still further embodiment, each of the notches is of a sized varying from the other notches. In a yet still further embodiment, the forward wrench portion is comprised of an upper plate having a forward end and a rearward end. Said upper plate further has an aperture formed therethrough. Also, a lower plate having a forward end and rearward end is provided. Said lower plate further has an aperture formed therethrough. The aperture of the lower plate is substantially identical to the aperture of the upper plate. Said upper plate and the lower plate are positioned substantially parallel to one another having the apertures thereof being in substantial alignment with one another. A pair of side walls are positioned between and are integral with the upper and the lower plates. One of said side walls is positioned between the forward ends of said plates. The other of said side walls is positioned between the rearward end of said plates, being integral with the gripping portion of the handle. In this manner, the substantially slotted channel is defined extending laterally between the upper plate and the lower plate.

In another embodiment, the wrench plate is rotatably mounted on a rivet carried by the upper plate and the lower plate. In another embodiment, the wrench further has a detent means for maintaining the wrench plate in a stationary position during the use thereof. In another embodiment this detent means is a ball-spring detent mechanism. And in still another embodiment, the detent mechanism is comprised of the wrench plate having a plurality of detent pockets formed therein radially about the center axis thereof. Each of said detent pockets is further positioned between the axis and a respective notch and is in substantially radial alignment therewith. A spring-loaded, ball-detent is provided. This ball-detent has a first seated position, wherein the ball engages a respective detent pocket disengagably maintaining the wrench plate in a stable position. This ball detent further has a second unseated position, wherein the ball is disengaged from a detent pocket for the free rotational movement of the wrench plate.

In still further accordance with the teachings of the present invention, a wrench for tightening and loosening a workpiece having a polygonal shaped body is provided. This wrench has a handle having a rearward gripping portion and a forward wrench portion integral therewith. The forward wrench portion has an upper plate having a forward end and a rearward end and further having an aperture formed therethrough. A lower plate is provided having a forward end and rearward end, and further having an aperture formed therethrough. Said aperture is substantially identical to the aperture of the upper plate. Said upper plate and the lower plate are positioned substantially parallel to one another having the apertures thereof being in substantial alignment with one another, wherein an aperture including a gripping portion is formed therethrough. A pair of side walls are positioned between and integral with the upper and the lower plates. One of said side walls is positioned between the forward ends of said plates. The other of said side walls is positioned between the rearward end of said plates, integral with the gripping portion of the handle. A substantially slotted channel is thereby defined extending laterally between the upper plate and the lower plate.

A wrench plate is provided including a periphery. A rivet is provided. Said plate is mounted for rotational movement in the slot about a centrally positioned axis upon the rivet.

Said wrench plate has a plurality of notches of varying sizes formed therein about the periphery thereof, such that said notches may be selectively positioned in communication with the aperture, whereby the workpiece may be disposed between the gripping portion of the aperture and received within a respective selected notch, where it is gripped for the tightening and removal thereof. The aperture has a hexagonal configuration. Three adjacent sides of the hexagonal aperture positioned nearest to the gripping portion of the handle are each formed having a length being substantially identical to each other. A fourth side is adjacent to one side of the said three adjacent sides. A fifth side is adjacent to the other opposite side of the said three adjacent sides. Said fourth and fifth sides each have a length being substantially identical to one another and each further has a length being substantially longer than any one of the three adjacent sides. A sixth side is positioned between and adjacent to the fourth side and the fifth side. The internal angle between each adjacent side of the aperture is substantially 120°. The gripping portion of the aperture is comprised of the fourth side, fifth side, and the sixth side. Finally, the notches of the wrench plate are each formed having three sides, each of said sides having a length being substantially identical to one another.

DESCRIPTION OF THE PREFERRED EMBODIMENT

Figure 1:
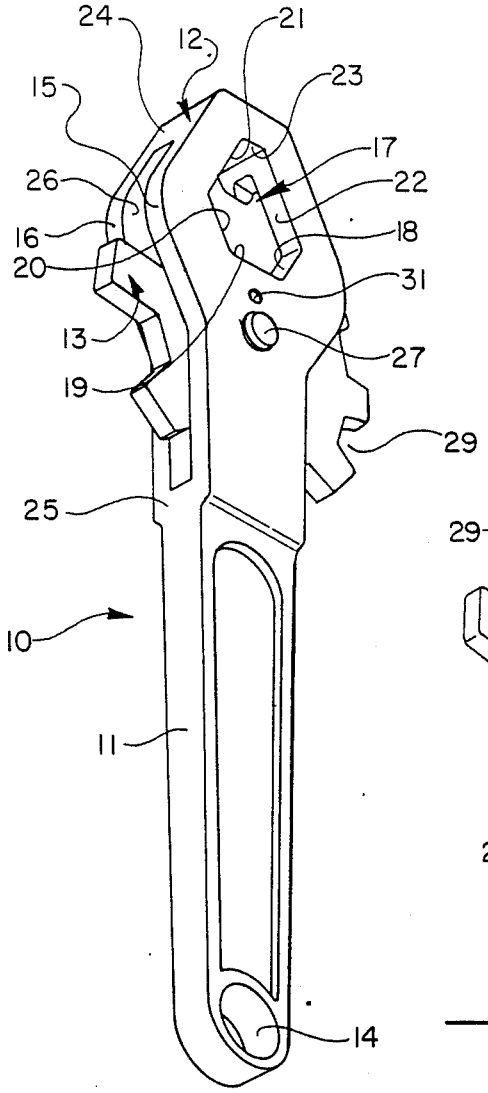
FIG. 1 is an elevated view, in perspective, of the adjustable wrench of the present invention.
Figure 2:
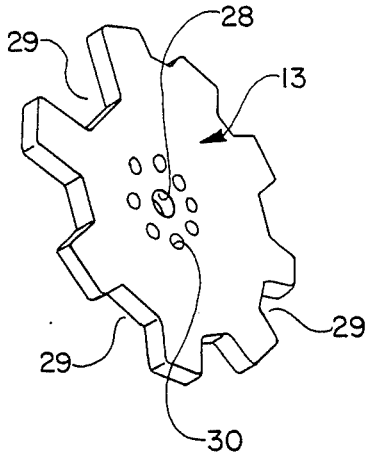
FIG. 2 is an elevated view, in perspective, of the wrench wheel of the present invention removed from the wrench for the sake of clarity.
Figure 3:
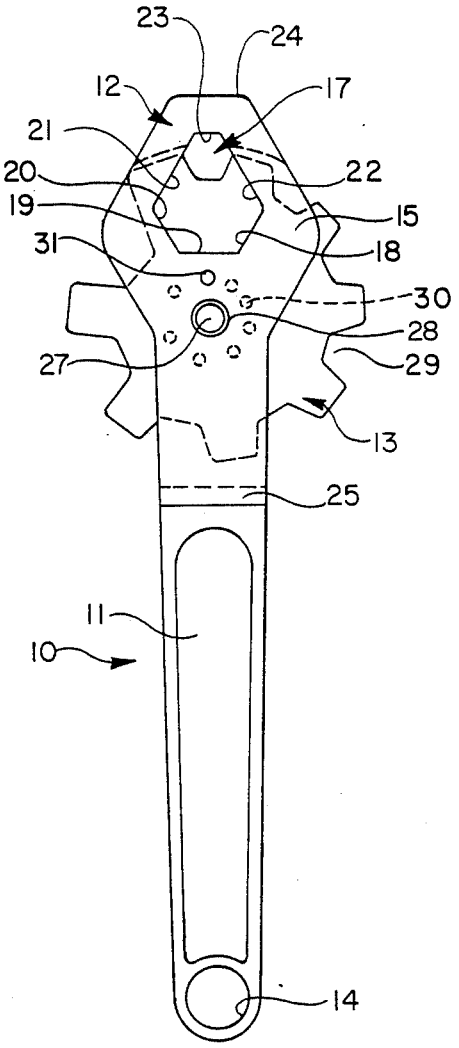
FIG. 3 is a top plan view of the wrench of FIG. 1.
Figure 4:
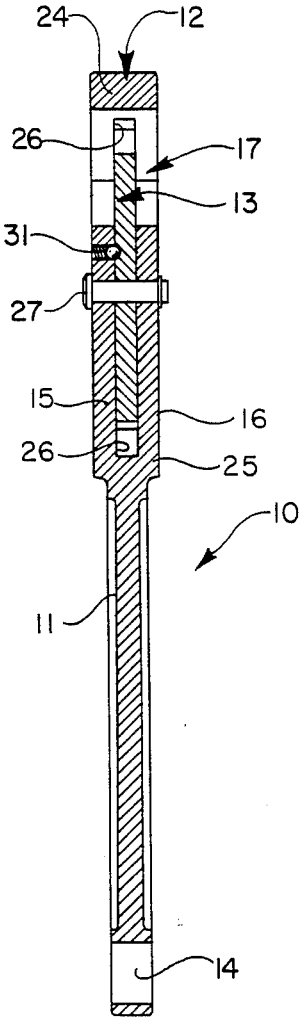
FIG. 4 is a cross-sectional view taken along lines 4—4 of FIG. 3.

With reference now to the drawings, the adjustable wrench 10 of the present invention is comprised generally of a handle having a rearward gripping portion 11 and a wrench portion 12 positioned forwardly thereof and being integral therewith. A wrench wheel 13 is rotatably mounted in the forward wrench portion (wrench head) 12.

The handle has an elongated solid gripping portion 11 being preferably, substantially rectangular in cross-section. The rearward end of the gripping portion 11 has an aperture 14 formed therethrough. Aperture 14 is provided for ease of storage or for any other useful purpose.

The forward end of the gripping portion 11 is integrally formed with the rearward end of the wrench portion 12. Said wrench portion 12 is comprised of an upper plate 15 having a forward end and a rearward end and a lower plate 16 also having a forward end and a rearward end. Said plates 15 and 16 are positioned thusly being substantially parallel to one another. Each of said plates 15 and 16 is formed having a respective aperture 17 (having a gripping portion) formed therethrough. Each of said apertures 17 are substantially identical in shape and appearance to each other. Formed thusly, each of said apertures is positioned being in substantial alignment with one another.

Preferably, each of said apertures 17 has a polygonal configuration. In particular, it is preferred that this polygonal configuration be a hexagonal. It is further preferred that the three adjacent sides 18, 19 and 20 of each of the hexagonal apertures, which are positioned nearest to the gripping portion 11 of the handle are formed having a length being substantially identical to one another. A fourth side 21 is adjacent to one of the said three adjacent sides 18, 19 and 20 and a fifth side 22 is adjacent to the other opposite side of the said three adjacent sides 18, 19 and 20. Said fourth side 21 and said fifth side 22 each are forced having a length being substantially identical to one another, and each side 21 and 22 further has a length being substantially longer than any one side of the said three adjacent sides 18, 19 and 20. Finally, a sixth side 23 is positioned between and is adjacent to the fourth side 21 and the fifth side 22. The sixth side 23 is the side of the aperture 17 having the shortest length. Formed thusly the internal angle between each adjacent sides 18, 19, 20, 21, 22 or 23 is substantially 120°. Also formed thusly, the fourth side 21, fifth side 22 and the sixth side 23 of the aperture 17 comprise the gripping portion of the aperture.

While described above thusly, as will be understood by those skilled in the art, the aperture may be formed having any one of a number of suitable polygonal configurations such as a pentagon, an octagon, etc. It is also to be understood that the lengths of the various sides, as well as their positioning may also be varied in accordance with the teachings of the present invention. Further, it is also contemplated that the three adjacent sides of the aperture having the same length may be oriented in any direction with corresponding changes in the orientation of the wrench plate.

The wrench portion 12 is further comprised of a one, upper sidewall 24 and a second (other) lower sidewall 25. The upper sidewall 24 is positioned between the respective forward ends of the upper plate 15 and the lower plate 16, being integral therewith. As such, sidewall 24 joins plates 15 and 16 at their respective forward ends.

The lower sidewall 25 is positioned between the respective rearward ends of the upper plate 15 and the lower plate 16, being integral therewith. As such, sidewall 25 joins plates 15 and 16 at their respective rearward ends. Lower sidewall 25 is further integral with the forward end of the gripping portion 11, thereby joining the rearward end of the wrench portion 12 with the forward end of the gripping portion 11, whereby the handle is formed.

Being joined as described above, a substantially slotted channel (slot) 26 is formed through the forward wrench portion 12. This channel 26 is defined extending substantially laterally between the upper plate 15 and the lower plate as joined by the sidewalls 24 and 25.

Removeably received and mounted for rotational movement within the channel (slot) 26 about a substantially centrally positioned rivet 27 is the wrench plate 13. Rivet 27 is received through the aperture 28 formed at the substantially central axis of the plate 13 (FIG. 28) and thereby rotatably carries the plate 13 thereon. The rivet 27 is, in turn, carried by the upper plate 15 and the lower plate 16.

It is to be understood by those skilled in the art that, although described above as preferably being rotatably mounted within the slot, the wrench plate may, alternatively, be otherwise removably received in the slot such as by a resilient detent means, frictional means, etc.

The wrench plate 13 has a periphery. Formed in the periphery of the wrench plate 13 is a plurality of notches 29. Each of the notches 29 is formed having three sides, each of which have a length being substantially identical to the other sides 29. The sides of each of said notches 29 are each further formed having a length which varies from the length of the sides of the other notches, whereby each of the notches is formed having a size varying from the size of the other notches. Preferably, this variation is one of substantially uniformly increasing or decreasing magnitude. Formed and mounted as described above, each of the notches 29 may be selectively positioned in communication with the aperture by rotational movement of the wrench plate 13, whereby the workpiece may be disposed between the gripping portion of the aperture and received within a selective notch 29 of the wrench plate 13 where said workpiece is gripped for the tightening and/or removal thereof.

When the desired sized wrench opening (as defined by the gripping portion of the aperture and the selective notch) is selected, the wrench plate 13 may be "locked" and maintained in a stationary position during use thereof by a suitable detent means. As will be appreciated by those skilled in the art, any one of a number of suitable detent means may be employed such as spring clips. In the preferred embodiment, the present invention employs a ball-spring detent mechanism comprised of a plurality of detent pockets 30 formed in the wrench plate 13 radially about the center axis (the pivot axis) thereof. Said detent pockets 30 are further formed being positioned in substantially radial alignment between the axis and a respective notch. Preferably, one detent pocket for each respective notch is so formed and positioned.

A spring-loaded, ball-detent 31 is provided being positioned and carried (in communication with the slotted channel 26) by the upper plate 15 so that the spring constantly urges the ball member in a direction towards the lower plate 16. Positioned and biased thusly, detent means 31 has a first seated position, wherein the ball engates a respective detent pocket 30, disengagably maintaining the wrench plate in a stationary, stable position during the use thereof. The detent means 31 further has a second, unseated position, wherein the ball is disengaged (by manual action or otherwise) from a detent pocket, engaging the surface of the wrench plate 13 providing for the full rotational movement thereof.

In the first seated position, a selective notch 29 is in communication (alignment) with the apertures 17, so that the desired, particular selected and appropriately sized wrench opening is formed, whereby the head of a workpiece may be suitably, snugly received in the wrench opening for the placement and/or replacement thereof.

In the second, unseated position, the wrench plate may be manually rotated for selecting the notch, and accordingly the appropriately sized wrench opening desired.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench for tightening and loosening a workpiece having a polygonal-shaped body, said wrench comprising:

a handle having a rearward gripping portion and a forward wrench portion integral therewith;

said forward wrench portion having a slot formed therethrough, said forward wrench portion further having an aperture including a gripping portion being formed therethrough;

a wrench plate being removeably received in the slot;

said wrench plate including a periphery having a plurality of notches formed therein, such that each of said notches may be selectively positioned in communication with the aperture, whereby the workpiece may be disposed between the gripping portion of the aperture and received within a selective notch of the wrench plate where it is gripped for the tightening and removal thereof.

2. A wrench for tightening and loosening a workpiece having a polygonal shaped body comprising:

a handle having a rearward gripping portion and a forward wrench portion integral therewith;

said forward wrench portion having a slot formed therethrough, said forward wrench portion further having an aperture including a gripping portion being formed therethrough;

a wrench plate including a periphery, said plate being mounted for rotational movement in the slot about a centrally positioned axis;

said wrench plate having a plurality of notches formed therein about the periphery thereof, such that said notches may be selectively positioned in communication with the aperture, whereby the workpiece may be disposed between the gripping portion of the aperture and received within a respective selected notch, where it is gripped for the tightening and removal thereof.

3. The wrench of claim 2, wherein the aperture has a polygonal configuration.

4. The wrench of claim 3, wherein the polygonal configuration is hexagonal.

5. The wrench of claim 4, wherein three adjacent sides of the hexagonal aperture being positioned nearest to the gripping portion of the handle are each formed having a length being substantially identical to each other; a fourth side is adjacent to one side of the said three adjacent sides; a fifth side is adjacent to the other opposite side of the said three adjacent sides, said fourth and fifth sides each having a length being substantially identical to one another and each further having a length being substantially longer than any one of the three adjacent sides; a sixth side, positioned between and adjacent to the fourth side and the fifth side; and further wherein the internal angle between each adjacent side of the aperture is substantially 120°.

6. The wrench of claim 5, wherein gripping portion of the aperture is comprised of the fourth side, fifth side, and the sixth side.

7. The wrench of claim 2, wherein the notches of the wrench plate are each formed having three sides, each of said sides having a length being substantially identical to each other.

8. The wrench of claim 2, wherein each of the notches is of a size varying from the other notches.

9. The wrench of claim 2, wherein the forward wrench portion is comprised of:

an upper plate having a forward end and a rearward end and further having an aperture formed therethrough;

a lower plate having a forward end and rearward end and further having an aperture formed therethrough, said aperture being substantially identical to the aperture of the upper plate, said upper plate and the lower plate being positioned substantially parallel to one another having the apertures thereof being in substantial alignment with one another;

a pair of side walls being positioned between and integral with the upper and the lower plates, one of said side walls being positioned between the forward ends of said plates, and the other of said side walls being positioned between the rearward end of said plates, integral with the gripping portion of the handle;

wherein the substantially slotted channel is defined extending laterally between the upper plate and the lower plate.

10. The wrench of claim 2, wherein the wrench plate is rotatably mounted on a rivet carried by the upper plate and the lower plate.

11. The wrench of claim 2, further comprised of a detent means for maintaining the wrench plate in a stationary position during the use thereof.

12. The wrench of claim 11, wherein the detent means is a ball-spring detent mechanism.

13. The wrench of claim 12, wherein the detent mechanism is comprised:

the wrench plate having a plurality of detent pockets formed therein radially about the center axis thereof, each of said detent pockets being further positioned between the axis and a respective notch in substantially radial alignment therewith;

a spring-loaded, ball-detent having a first seated position, wherein the ball engages a respective detent pocket disengagably maintaining the wrench plate in a stable position and further having a second unseated position, wherein the ball is disengaged from a detent pocket for the free rotational movement of the wrench plate.

14. The wrench of claim 2, wherein a detent means is provided for maintaining the wrench plate in a stationary position during the use thereof, comprised of:

the wrench plate having a plurality of detent pockets formed therein radially about the center axis thereof, each of said detent pockets being further positioned in substantially radial alignment between the axis and a respective notch;

a spring-loaded, ball-detent having a first seated position, wherein the ball engages a respective detent pocket disengagably maintaining the wrench plate in a stable position, and further having a second unseated position, wherein the ball is disengaged from a detent pocket for the free rotational movement of the wrench plate.

15. A wrench for tightening and loosening a workpiece having a polygonal shaped body comprising:

a handle having a rearward gripping portion and a forward wrench portion integral therewith, said forward portion including an upper plate having a forward end and a rearward end and said upper plate further having an aperture formed therethrough, said forward portion further including a lower plate having a forward end and rearward end, said lower plate further having an aperture formed therethrough, said aperture being substantially identical to the aperture of the upper plate, said upper plate and the lower plate being positioned substantially parallel to one another having the apertures thereof being in substantial alignment with one another, wherein an aperture including a gripping portion is defined being formed therethrough, said forward portion still further including a pair of side walls being positioned between and integral with the upper and the lower plates, one of said side walls being positioned between the forward ends of said plates, and the other of said side walls being positioned between the rearward end of said plates, said other of the side walls further being integral with the gripping portion of the handle, wherein the substantially slotted channel is defined extending laterally between the upper plate and the lower plate;

a rivet carried by the upper plate and the lower plate and extending therebetween;

a wrench plate including a periphery, said plate being mounted upon the rivet for rotational movement in the slot about a centrally positioned axis;

said wrench plate having a plurality of notches of varying sizes formed therein about the periphery thereof, such that said notches may be selectively positioned in communication with the aperture, whereby the workpiece may be disposed between the gripping portion of the aperture and received within a respective selected notch, where it is gripped for the tightening and removal thereof; wherein the aperture has a hexagonal configuration; wherein three adjacent sides of the hexagonal aperture being positioned nearest to the gripping portion of the handle are each formed having a length being substantially identical to each other; a fourth side is adjacent to one side of the said three adjacent sides; a fifth side is adjacent to the other opposite side of the said three adjacent sides, said fourth and fifth sides each having a length being substantially identical to one another and each further having a length being substantially longer than any one of the three adjacent sides; a sixth side, positioned between and adjacent to the fourth side and the fifth side; and further wherein the internal angle between each adjacent side of the aperture is substantially 120°; wherein the gripping portion of the aperture is comprised of the fourth side, fifth side, and the sixth side; wherein the notches of the wrench plate are each formed having three sides, each of said sides having a length being substantially identical to each other.

* * * * *